US005158749A

United States Patent [19]

Eberle

[11] Patent Number: 5,158,749

[45] Date of Patent: Oct. 27, 1992

[54] INSERT BEAKER FOR CENTRIFUGES

[75] Inventor: Günter Eberle, Tuttlingen, Fed. Rep. of Germany

[73] Assignee: Andreas Hettich, Tuttlingen, Fed. Rep. of Germany

[21] Appl. No.: 491,702

[22] Filed: Mar. 12, 1990

[30] Foreign Application Priority Data

Mar. 10, 1989 [DE] Fed. Rep. of Germany ... 8902975[U]

[51] Int. Cl.[5] ..... B01L 3/00; B04B 15/00

[52] U.S. Cl. ..... 422/102; 422/104; 494/20; 494/45; 494/16; 220/339; 206/470

[58] Field of Search ..... 206/470; 494/20, 21, 494/17, 16, 45; 229/2.5 R; 220/337, 339; 422/102, 104

[56] References Cited

U.S. PATENT DOCUMENTS 3,511,433 5/1970 Andrews et al. ..... 220/4.23
4,336,883 6/1982 Krug et al. ..... 220/339
4,439,177 3/1984 Conway ..... 494/20
4,553,692 11/1985 Padovani ..... 220/339
4,582,606 4/1986 McCurty ..... 494/221
4,617,009 10/1986 Ohlim et al. ..... 494/21

FOREIGN PATENT DOCUMENTS 2029360 3/1980 United Kingdom .

*Primary Examiner*—James C. Housel
*Assistant Examiner*—Long V. Le
*Attorney, Agent, or Firm*—Browdy and Neimark

[57] ABSTRACT

An insert beaker for centrifuges for centrifuging blood, having a blood bag placed in the insert beaker in association with a positive displacement body that acts upon the insert beaker from outside, the blood bag communicating via connecting hoses with at least one other blood bag inside the centrifuge. The insert beaker (1) is made with two pivotable shell halves (2, 3) joined together, and retaining elements for the blood bag to be placed between the shell halves (2, 3) is disposed on the top of the shell halves (2, 3).

6 Claims, 2 Drawing Sheets

INSERT BEAKER FOR CENTRIFUGES

FIELD OF THE INVENTION

The present invention relates to an insert beaker for centrifuges for centrifuging blood, in which a bag of blood is inserted into the insert beaker in association with a positive displacement body that acts externally upon the insert beaker; the blood bag communicates via connecting hoses with at least one other blood bag inside the centrifuge.

BACKGROUND OF THE INVENTION

An insert beaker of this general type is already known from German Patent Document 29 38 367 C2. There, the insert beaker is provided in one container-like piece. The blood bag is introduced at least part way into the insert beaker, and connecting or supply hoses protrude upwardly away from the blood bag. With this type of insert beaker, it was difficult in particular to insert a full blood bag. There was also the danger that the hoses protruding from the blood bag might kink during the centrifuging and could possibly break.

It is also known to hold blood bags detachably on insert beakers by suitable retaining means. However, these retaining means are structurally relatively complicated, making the production cost for such an insert beaker relatively high.

SUMMARY OF THE INVENTION

It is therefore the object of the present invention to provide an insert beaker for centrifuges for receiving blood bags in such a way that the insert beaker can be produced at lower cost, is easier to use, and is more dependable.

To attain this object, the invention is characterized in that the insert beaker comprises two shell parts pivotably joined together with the blood bag to be placed between the shell parts and with a retaining means for the blood bag disposed on the top of these shell parts.

The shells are opened by pivoting them, and the blood bag is laid in between them and is then mounted with its corresponding attachment tab to the retaining means formed onto the shell halves. This retaining means need not necessarily be embodied as an insertable holder. It may be a simple clamp or some other guide means that prevents the hoses from kinking and breaking during centrifuging.

Further details of an embodiment of the insert beaker or shell parts as well as other objects and the nature and advantages of the invention will become more apparent from the following detailed description in conjunction with the drawings.

BRIEF DESCRIPTION OF THE DRAWINGS

The accompanying drawings illustrate the invention. In such drawings.

DETAILED DESCRIPTION OF THE PREFERRED EMBODIMENT

The insert beaker 1 in FIGS. 1–5 comprises two shell halves 2, 3, which are pivotably joined to one another via a film hinge 4. Naturally, other pivotable or articulated fastenings are possible instead of a film hinge, such as integral injection molded joint elements, straps that are riveted or glued on, or other such swivel bearings. For manufacturing reasons, however, the use of a film hinge is preferred, because an insert beaker of this kind is produced as an integral part by injection molding and in particular comprises an impact-resistant and wear-resistant plastic material.

The insert beaker has an interior 5 into which the blood bag can be inserted. The plastic that is preferably used is Arnitel (PBTB=polybutylene terephthalate).

Figure 2:
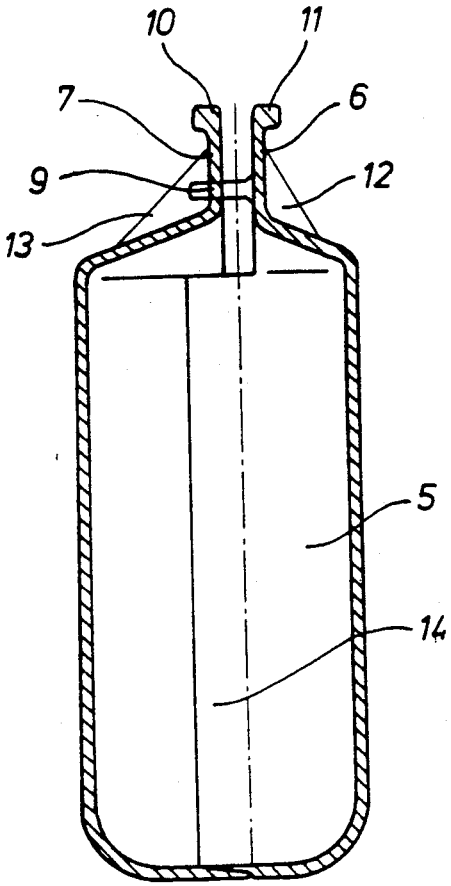
FIG. 2 is a section taken along the line II—II of FIG. 1.
Figure 1:
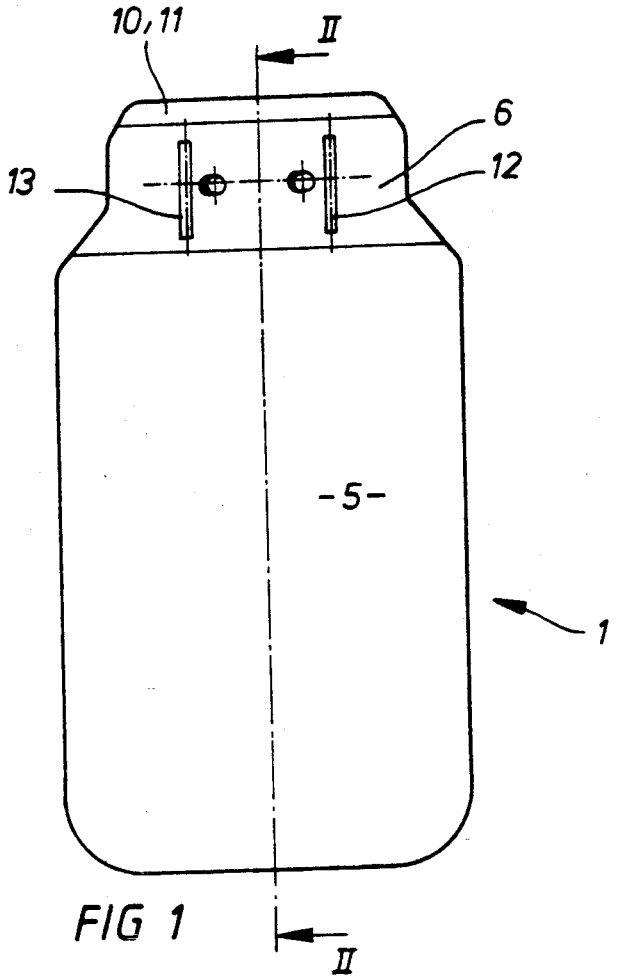
FIG. 1 is a plan view on an insert beaker 1 according to the invention.
Figure 3:
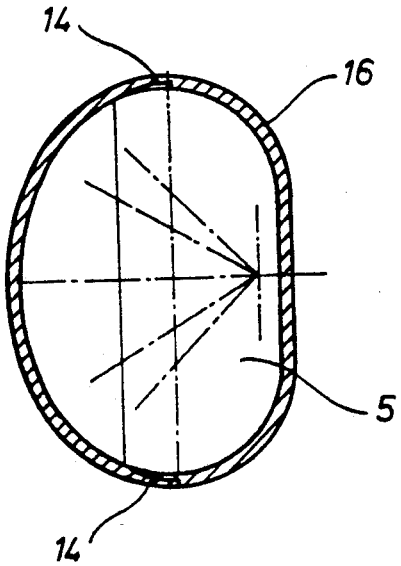
FIG. 3 is a section taken along the line III—III of FIG. 4, with the shell halves folded shut.
Figure 4:
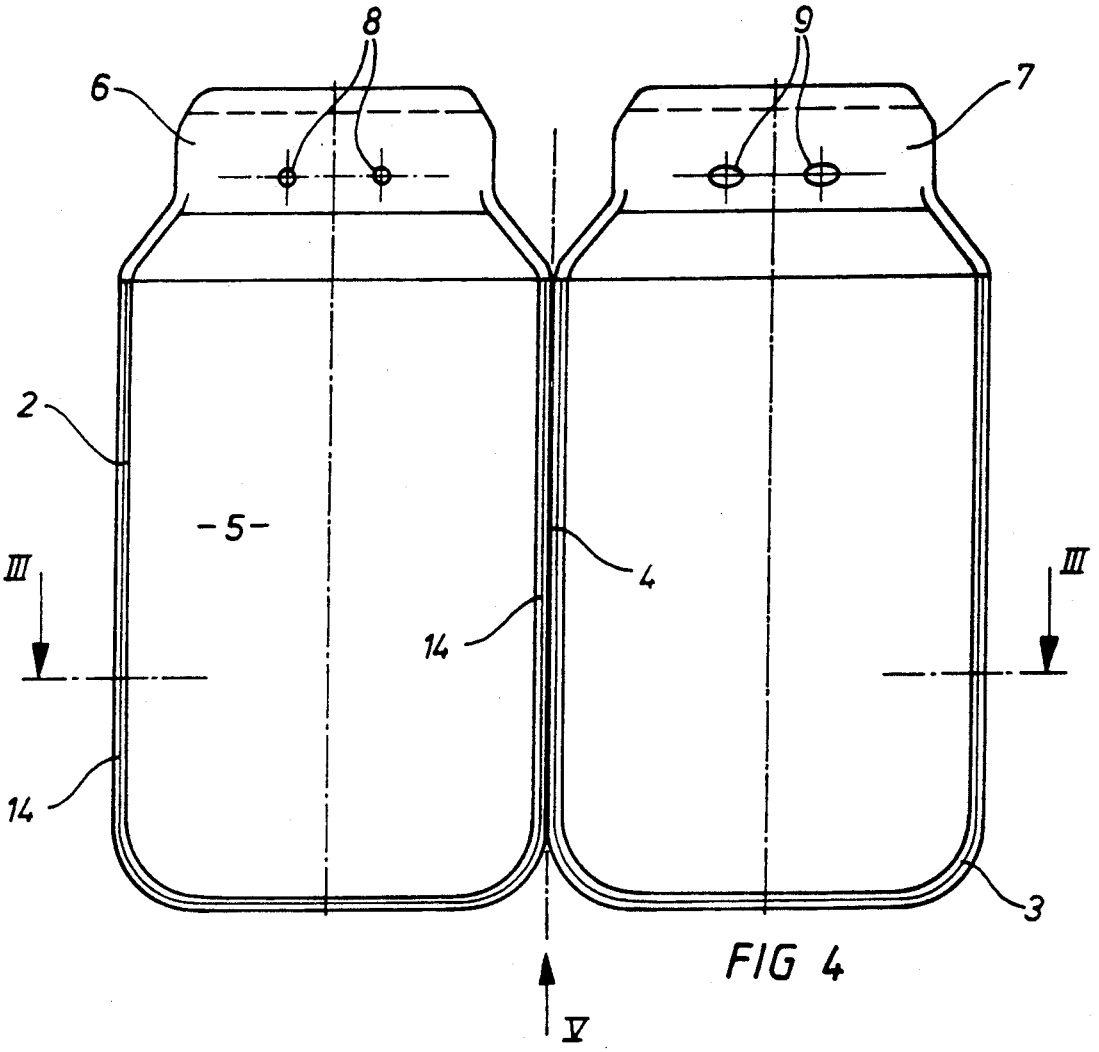
FIG. 4 is a plan view on the shell halves of the insert beaker, folded open.

Each shell half 2, 3 changes toward the top into a respective flange plate 6, 7. The flange plates 6, 7 face one another in the closed state (FIG. 2).

Stay bolts 8 are integrally formed onto one flange plate 6. Preferably the stay bolts 8 are made of the same material as the plastic of the insert beaker itself and are integrally joined in their material to it. However, instead of such stay bolts, metal stay bolts could be placed in the plastic material during the molding process.

In the closed state, the stay bolts of one flange plate 6 engage associated oblong recesses 9 in the opposite flange plate. The recesses are preferably embodied as oblong so that upon closure of the two shell halves the stay bolts 8 can be made to engage the recesses without particular friction or contact with the edges of the recesses. This kind of engagement is shown for example in FIG. 2.

A gripping edge 10, 11 is formed onto the top of each flange plate 6, 7, making it easier to grasp the entire insert beaker at the top. Another advantage is that simultaneously the gripping edge 10, 11 increases the mechanical strength of the respective flange plate 6, 7.

In a further feature of the present invention, reinforcement ribs 12, 13 are shown attached to the flange plates, supported on the top of the angled portion of the shell halves 2, 3. This improves the mechanical strength of the flange plates 6, 7.

Figure 5:
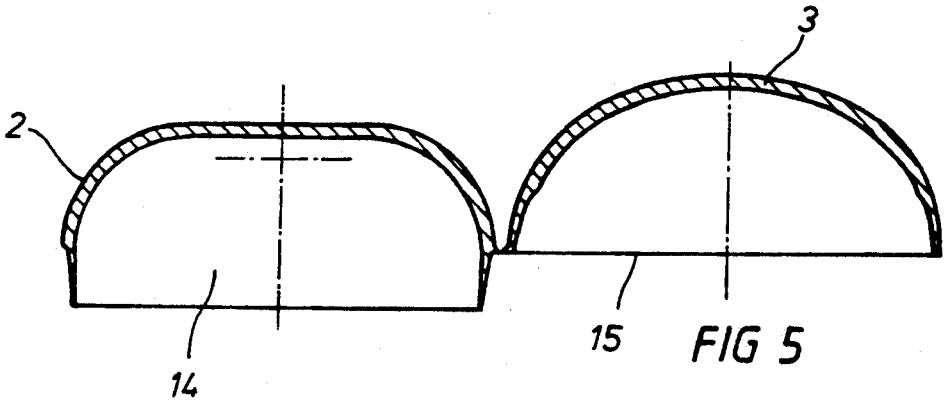
FIG. 5 is a view of the folded-open insert beaker from below, in the direction of the arrow V in FIG. 4.

As FIG. 5 shows, one shell half 2 has an encompassing lip 14 on its perimetral ridge. The encompassing lip 14 protruding past a corresponding indentation 15 on a perimetral ridge of the outer shell half 3 (see FIG. 5). This protruding, encompassing lip 14 is intended to assure accurate centering of the two shell halves 2, 3 with respect to one another as they are being closed. In this closure, this is accomplished in that when the shell halves meet, the encompassing lip 14 engages the interior of the other shell half first; centering the shell halves with respect to one another which makes closing easier.

The profile cross section 16 of the respective insert beaker 1 also corresponds precisely to the inside profile of the centrifuge beaker (metal centrifuge hanger attachment), into which the insert beaker is inserted. Thus the insert beaker fits form-fittingly and with relatively slight play into the span of the opening of a centrifuge hanger attachment.

Other advantages of the present invention are accordingly that by using an insert beaker according to the invention the blood bag is introduced into the beaker while the insert beaker is open. The insert beaker can then be cleanly closed, and the fully closed insert beaker inserted into the span of the opening of the centrifuge hanger attachment without further effort. The problems mentioned above thus do not arise.

The insert beaker above has a certain volume, which as a rule is adapted precisely to the volume of the blood bags to be centrifuged. In certain applications, however, there is a need to centrifuge blood bags that have a volume substantially less than the volume of the insert beaker. In that case it is provided that a hollow shell or cushion is also placed in the insert beaker and at least partly fills the volume of the insert beaker. This hollow shell or cushion 17, as shown schematically in FIG. 2, is placed in one shell half, while the blood bag with the reduced volume is placed in the other.

After this insert beaker is closed, the hollow shell or cushion comes to rest on the blood bag having the reduced volume, so that the interior of the insert beaker is completely filled. This supports the blood bag and protects it against collapsing, and it can thus be centrifuged dependably.

Various possible embodiments are available for the use of such a cushion in insert beakers.

In a first embodiment, the cushion can be glued, at a point or surface such as 18 as shown in FIG. 2 directly into the insert beaker and could for instance be inflatable with air or could contain a liquid.

In another embodiment, the cushion can be integrally joined in its material to the material of the insert beaker, (made by molding in one piece) so that the interior of the insert beaker can be enlarged or reduced in size as needed.

With the insert beaker described, blood bags of various volumes can accordingly be centrifuged substantially more reliably. At the same time, hoses and other delivery elements are reliably held and protected against kinking. These hoses and delivery elements are clamped in place with the bags by the flange plates, so that they are securely retained.

An essential feature here is that more than one bag can be received in this insert beaker. Insertion of a plurality of bags into the insert beaker can still be closed. The other bags are as a rule empty and can be introduced, folded up in some way, into the insert beaker along with the full bag to be centrifuged. Stuffing this multiple arrangement directly into the centrifuge hanger attachment itself presents difficulties, because these empty bags are otherwise very difficult to accommodate along with the full bag.

The foregoing description of the specific embodiments will so fully reveal the general nature of the invention that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation.

What is claimed is:

1. An insert beaker for centrifuges for centrifuging blood, wherein a blood bag is placed in the insert beaker, the blood bag communicating via connecting hoses with at least one other blood bag inside a centrifuge, said insert beaker (1) comprising, two pivotable shell halves (2, 3) joined together by a film hinge, retaining means for clamping hoses and supply lines of said blood bag and said blood bag placed between said shell halves (2, 3), said retaining means comprising, a flange plate (6, 7) on an upper portion of each of said two pivotable shell halves, stay bolts (8) on one said flange plate (6) engaged to recesses (9) on the other said flange plate (7), reinforcement ribs (12, 13) integrally formed on each flange plate (6, 7), each said flange plate spaced sufficiently from one another when said two pivotable shell halves are closed to permit clamping of said hoses and supply lines and said blood bag within said insert beaker, one shell half (2) having an encompassing lip (14) on a perimetral ridge, which engages a corresponding indentation (15) on a perimetral ridge of the other shell half (3) in a manner of the lap joint.

2. The insert beaker of claim 1, wherein the shell halves (2, 3) and the hinge comprise impact-resistant, wear-resistant plastic material.

3. The insert beaker of claim 1, wherein the top of each flange plate (6, 7), has an integrally formed gripping edge (10, 11).

4. The insert beaker of claim 1, wherein said insert beaker (1) has a hollow cushion disposed additionally on one of said shell halves (2, 3) in order to adapt the capacity of the insert beaker (1) to blood bags of small volume.

5. The insert beaker of claim 4, wherein said hollow cushion is glued into said insert beaker (1) and contains a fluid.

6. The insert beaker of claim 4, wherein said cushion is integral with the insert beaker and made of the material of the insert beaker (1).

* * * * *